US005129545A

United States Patent [19]

Parks

[11] Patent Number: 5,129,545

[45] Date of Patent: Jul. 14, 1992

[54] CONTAINER FOR DISPENSING AND DISPOSING OF TISSUES

[76] Inventor: Lance K. Parks, 311 Parkhill Dr., Billings, Mont. 59101

[21] Appl. No.: 529,378

[22] Filed: May 29, 1990

[51] Int. Cl.[5] ..... B65H 1/00

[52] U.S. Cl. ..... 221/34; 221/63; 221/102

[58] Field of Search ..... 221/47–48, 221/52, 58, 63, 102, 34, 35; 229/120.22

[56] References Cited

U.S. PATENT DOCUMENTS

| | | | |
|---|---|---|---|
| 1,988,939 | 1/1935 | Craig | 221/102 |
| 2,915,218 | 12/1959 | Rosenman et al. | 221/102 |
| 3,095,087 | 6/1963 | Yates | 221/34 |
| 3,221,928 | 12/1965 | Horn | 221/102 |
| 3,744,663 | 7/1973 | Mofeti | 229/120.22 |
| 4,151,910 | 5/1979 | Yasur | 221/102 |
| 4,180,160 | 12/1979 | Ogawa et al. | 221/63 |
| 4,411,374 | 10/1983 | Hotchkiss | 221/63 |
| 4,526,291 | 7/1985 | Margulies | 221/63 |
| 4,616,767 | 10/1986 | Seido | 221/58 |

FOREIGN PATENT DOCUMENTS

| | | | |
|---|---|---|---|
| 464373 | 4/1937 | United Kingdom | 221/102 |

*Primary Examiner*—H. Grant Skaggs
*Attorney, Agent, or Firm*—Richard C. Conover

[57] ABSTRACT

An improved tissue container having a dispenser compartment and disposal compartment. The container has a tissue dispensing opening in the dispensing compartment and a tissue receiving opening in the disposal compartment through which soiled tissue may be inserted. The two compartments are formed on opposite sides of a flexible, bag-like liner with the liner opening only at the soiled tissue receiving opening. The bag-like liner prevents contaminants from contaminating the clean tissue compartment. The liner is arranged so that a load of clean tissues in the clean tissue compartment provides supporting structure to keep the liner from snarling and restricting the available space in the disposal compartment.

4 Claims, 1 Drawing Sheet

CONTAINER FOR DISPENSING AND DISPOSING OF TISSUES

BACKGROUND OF THE INVENTION

This invention relates to an improved container having a tissue dispensing compartment for holding clean tissues and a disposal compartment for receiving soiled or waste tissues.

Sanitary tissues are widely used around the home and while travelling. The "throw-away" characteristic of these tissues frequently creates a problem as to how to dispose of them. The tissues are often withdrawn from a box, used, and then discarded in an unsanitary way because a disposal receptacle is not handy. Receptacles have been designed having two compartments in a single container for dispensing and receiving tissues. For instance U.S. Pat. No. 1,988,939 to Craig; U.S. Pat. No. 2,566,016 to Cochran; U.S. Pat. No. 3,372,837 to Neumann; and U.S. Pat. No. 2,915,218 to Rosenman et al., all illustrate the use of two compartments in a single container. However, these containers use a firm wall separating the container into two compartments of substantially fixed volumes. These containers, which are twice as large as a container holding only tissues, are bulky and awkward to carry. Initially, the dispensing compartment is loaded with clean tissues while the disposal compartment is empty. Then as all the tissues are used, the dispensing compartment is emptied while the disposal compartment is filled. The overall volume of the container remains approximately the same size.

U.S. Pat. No. 3,221,928 to Horn solves the problem of having a bulky container by providing a container which has two compartments where the disposal compartment expands into the volume of the dispensing compartment. But, this device has a plurality of slots providing passageways between the disposal compartment and the dispensing compartment which passageways are continually open throughout the period of time the box is being used. Moisture and contaminants can easily pass through the passageways to contaminate the clean tissues. This creates an unsanitary condition, since soiled tissues are unusually hygienically unclean. Soiled tissues need to be isolated from the clean tissues to prevent the spread of infectious diseases.

Thus, a need exits to have a container with a tissue-dispensing compartment and with a disposal compartment hygienically separated from the clean tissue compartment.

SUMMARY OF INVENTION

The present invention relates to a an improved tissue container having a dispensing compartment and a disposal compartment. The container has a tissue dispensing opening in the dispensing compartment and a tissue receiving opening in the disposal compartment through which soiled tissue may be inserted. The two compartments are formed on opposite sides of a flexible, bag-like liner with the liner opening only at the soiled tissue receiving opening. The bag-like liner prevents contaminants from contaminating the clean tissue compartment. The liner is arranged so that a load of clean tissues in the clean tissue compartment provides supporting structure to keep the liner from snarling and restricting the available space in the disposal compartment.

BRIEF DESCRIPTION OF THE DRAWINGS

In order that the invention may be clearly understood and readily carried into effect, preferred embodiments of the invention will now be described, by way of example only, with reference to the accompanying drawings wherein.

DESCRIPTION OF PREFERRED EMBODIMENT

Figure 1:
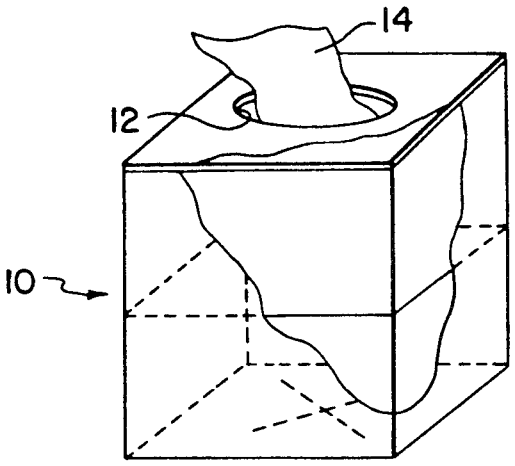
FIG. 1 is a perspective view of a tissue dispenser and disposal container according to the present invention.
Figure 2:
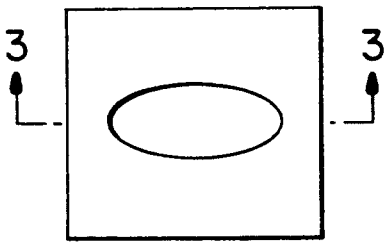
FIG. 2 is a top view of the tissue dispenser shown in FIG. 1.

A preferred embodiment of a container 10 for dispensing tissues and receiving waste tissues is shown in FIG. 1. At one end of container 10, a dispensing opening 12 is provided through which pre-folded tissues 14 may be removed. At the opposite end of container 10 from dispensing opening 12, a pair of crossed slits 16 provide an opening for receiving waste tissues.

Figure 3:
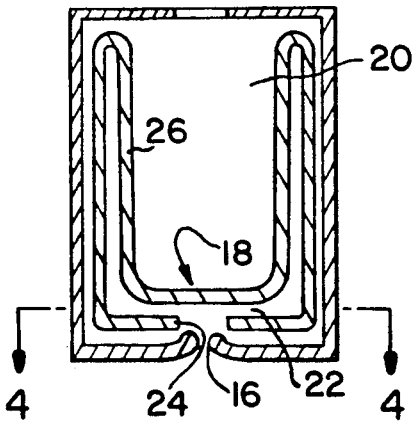
FIG. 3 is a cross-sectional view taken along the line 3—3 in FIG. 2.
Figure 4:
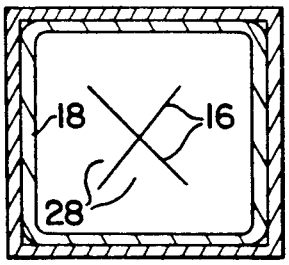
FIG. 4 is a cross-sectional view taken along the line 4—4 in FIG. 3.

A bag-like liner 18 is positioned within container 10 as best seen in FIG. 3 and divides container 10 into a dispensing compartment 20 and a disposal compartment 22. Clean tissues 14 are positioned in container 10 between liner 18 and dispensing opening 12. The bag-like liner 18 has an open end 24 positioned to receive tissues through slit 16. Further, the liner 18 is arranged so that the closed end is arranged such as shown in FIG. 3 with folded flank portions 26 which rest between container 10 and tissues 14.

When clean tissues 14 are loaded into the dispenser 10, the clean tissues provide structure for supporting the liner 18 to prevent the liner 18 from doubling on itself and snarling when soiled tissues are inserted into compartment 22.

With this arrangement of the liner 18, the liner serves to isolate clean tissues 14 from the disposal compartment 22. As tissues are removed from the top of the tissue stack at dispensing opening 12 and inserted into disposal compartment 22, the disposal compartment can expand into the volume vacated by the tissue removed through opening 12.

The pair of crossed slits 16 provide an opening into the dispenser disposal compartment 22 which is normally closed. The area between adjacent slit 16 constitutes a flap 28 which is elastic and bendable. Whenever flaps 28 are pushed inward at slits 16, the slits will open to provide ingress of a user's fingers to dispose of tissues into compartment 22, but flaps 28 will spring back to a closed position once a user's fingers are removed.

As can be seen, the liner 18 isolates the soiled tissues in compartment 22 from the clean tissues in compartment 20. Further, the liner may be formed of an impermeable plastic material and can further be impregnated with a disinfectant to prevent the spread of infection.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims:

I claim:

1. A tissue dispenser with a compartment for receiving waste tissue comprising:

a receptacle with a dispensing opening at one end and a receiving opening at an opposite end;

an open-ended, bag-like liner positioned within the receptacle with the open end positioned adjacent the receiving opening and the opposite end of the bag-like liner tucked inside the liner toward the open end to form a first compartment and a second compartment within the receptacle separated by the liner, the first compartment, formed by the outside of the bag-like liner and specifically the tucked in portion of the liner, opening into the dispensing opening and the second compartment, formed inside the bag-like liner, opening into the receiving opening.

2. A tissue dispenser according to claim 1 wherein the receiving opening is formed as a plurality of flaps formed between two intersecting slits which flaps elastically return toward a normally closed position with the flaps flying generally parallel in the same plane.

3. A tissue dispenser according to claim 1 wherein the tissue loaded into the dispenser provides supporting structure to prevent the liner from doubling on itself.

4. The tissue dispenser according to claim 3 wherein the liner comprises an impermeable plastic material.

* * * * *